US008216407B2

(12) United States Patent
Kalkanoglu et al.

(10) Patent No.: US 8,216,407 B2
(45) Date of Patent: Jul. 10, 2012

(54) PRE-ASSEMBLED HIP, RIDGE OR RAKE SHINGLE

(75) Inventors: Husnu M. Kalkanoglu, Swarthmore, PA (US); Gregory F. Jacobs, Oreland, PA (US); Erik F. Shay, Exton, PA (US); Alexander H. Plache, Wayne, PA (US)

(73) Assignee: CertainTeed Corporation, Valley Forge, PA (US)

( * ) Notice: Subject to any disclaimer, the term of this patent is extended or adjusted under 35 U.S.C. 154(b) by 271 days.

(21) Appl. No.: 12/601,545

(22) PCT Filed: Sep. 25, 2009

(86) PCT No.: PCT/US2009/058394

§ 371 (c)(1),
(2), (4) Date: Nov. 24, 2009

(87) PCT Pub. No.: WO2011/037575

PCT Pub. Date: Mar. 31, 2011

(65) Prior Publication Data

US 2011/0185650 A1 Aug. 4, 2011

(51) Int. Cl.
*B32B 37/00* (2006.01)

(52) U.S. Cl. ..... 156/73.1; 156/73.5

(58) Field of Classification Search ..... 156/73.1, 156/73.4, 73.5, 73.6, 157, 308.2, 502, 544, 156/580, 580.1, 580.2

See application file for complete search history.

(56) References Cited

U.S. PATENT DOCUMENTS

| | | | | |
|---|---|---|---|---|
| 4,628,650 | A | 12/1986 | Parker | |
| 4,936,069 | A | 6/1990 | Hunter et al. | |
| 5,109,149 | A | 4/1992 | Leung | |
| 5,122,095 | A | 6/1992 | Wolfert | |
| 5,271,201 | A | 12/1993 | Noone et al. | |
| 5,295,340 | A | 3/1994 | Collins | |
| 5,419,941 | A | 5/1995 | Noone et al. | |
| 5,458,538 | A | 10/1995 | MacLeod et al. | |
| D366,335 | S | 1/1996 | Noone et al. | |
| D366,336 | S | 1/1996 | Noone et al. | |
| 5,772,502 | A | 6/1998 | Smith | |
| 6,418,692 | B1 | 7/2002 | Freshwater et al. | |
| 6,482,084 | B2 | 11/2002 | Hansen | |
| 7,178,294 | B2 | 2/2007 | Jolitz | |
| 2005/0204697 | A1 | 9/2005 | Rue | |
| 2006/0117689 | A1 | 6/2006 | Onken et al. | |
| 2008/0229695 | A1 * | 9/2008 | Kalkanoglu et al. | 52/520 |

* cited by examiner

*Primary Examiner* — James Sells
(74) *Attorney, Agent, or Firm* — Paul & Paul

(57) ABSTRACT

A hip, ridge or rake shingle is provided, in which a pair of substantially rigid panel portions are connected by a hinge portion, and wherein the shingle is pre-assembled, but can conform to a variety of different angles to accommodate different angular relationships between surfaces of a hip, ridge or rake of a roof. The substantially rigid panel portions are connected by a hinge and may or may not have a reinforcement member, and all of the panels, hinges and reinforcement members are of synthetic thermoplastic polymeric construction and are welded together by ultrasonic or vibratory welding techniques.

10 Claims, 9 Drawing Sheets

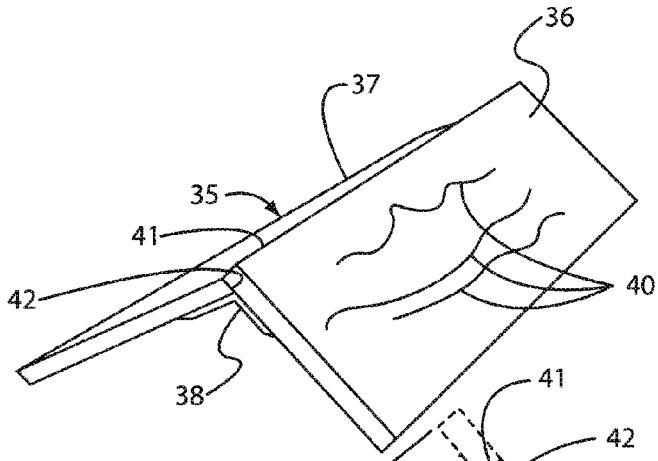
Fig. 4
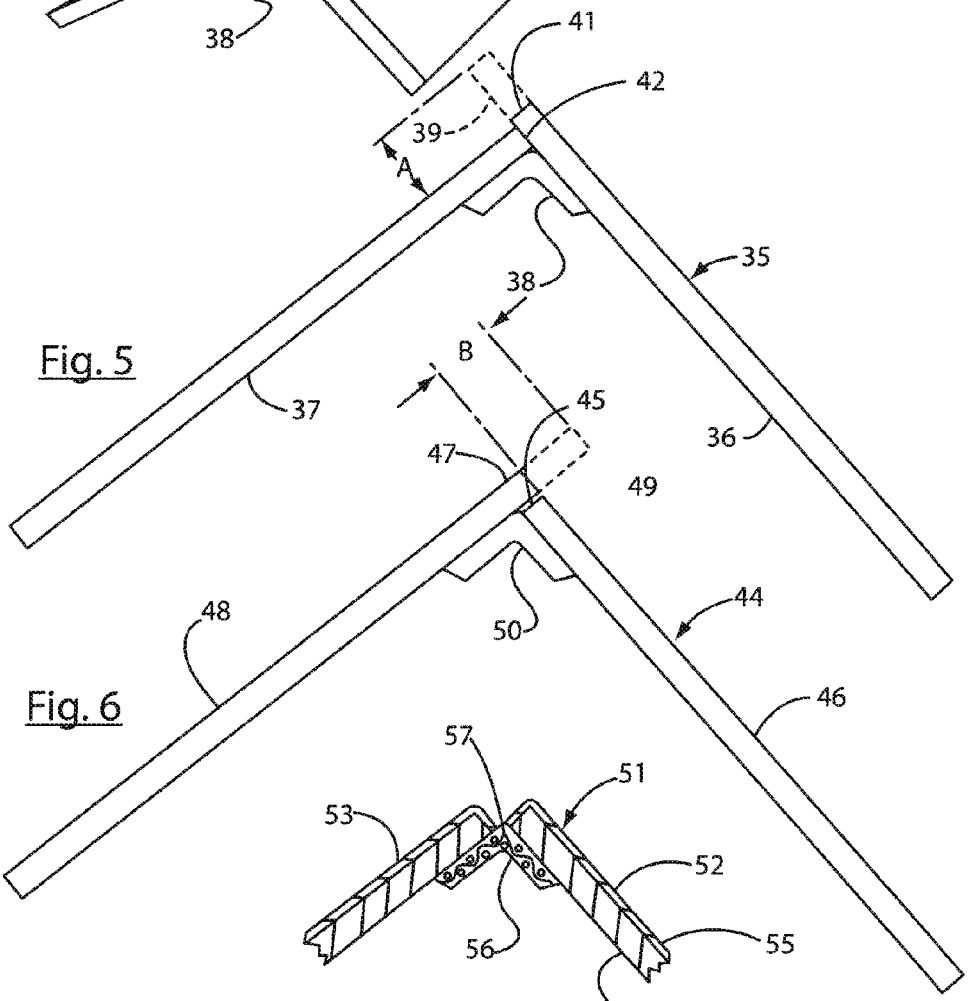
Fig. 5
Fig. 6
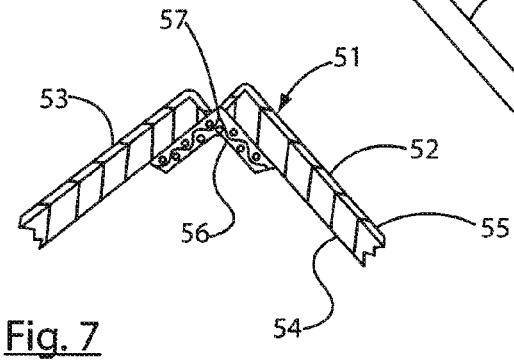
Fig. 7

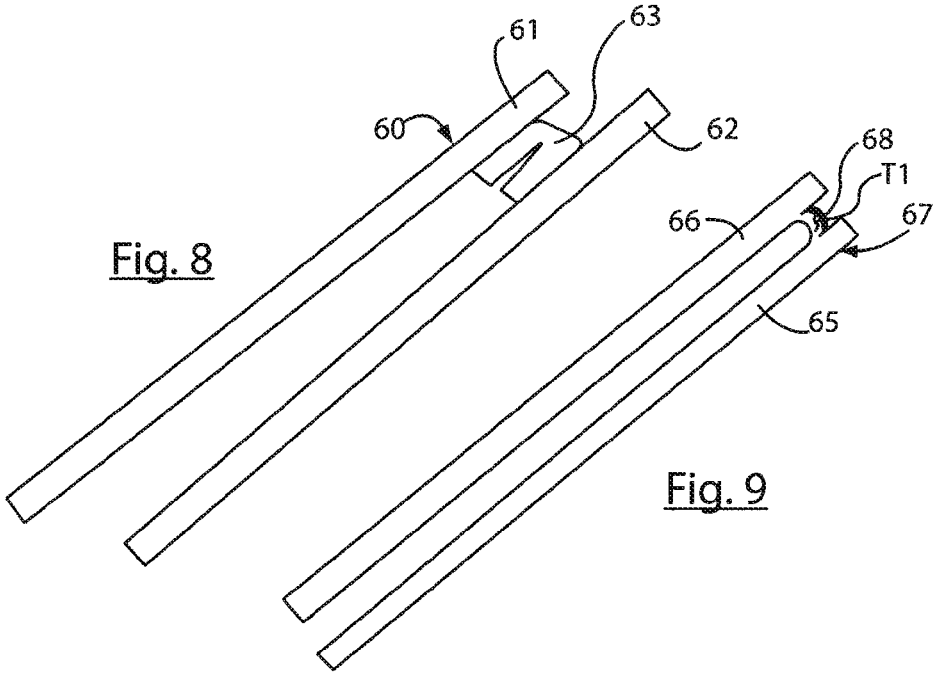
Fig. 8
Fig. 9
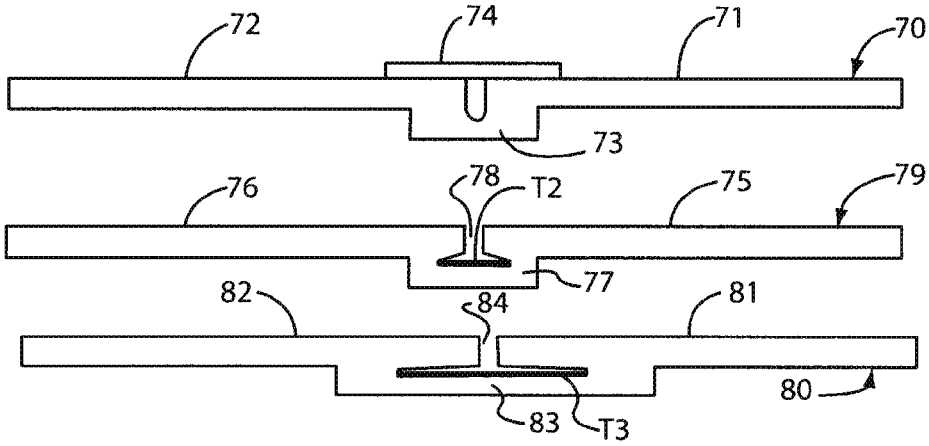
Fig. 10
Fig. 11
Fig. 12

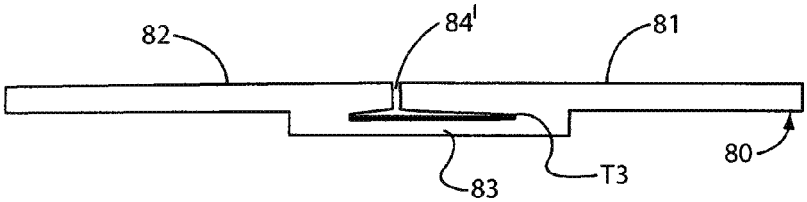
Fig. 12A
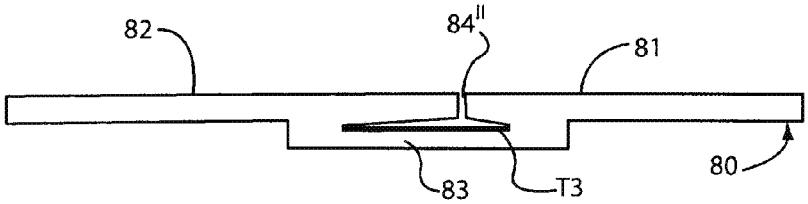
Fig. 12B
Fig. 13
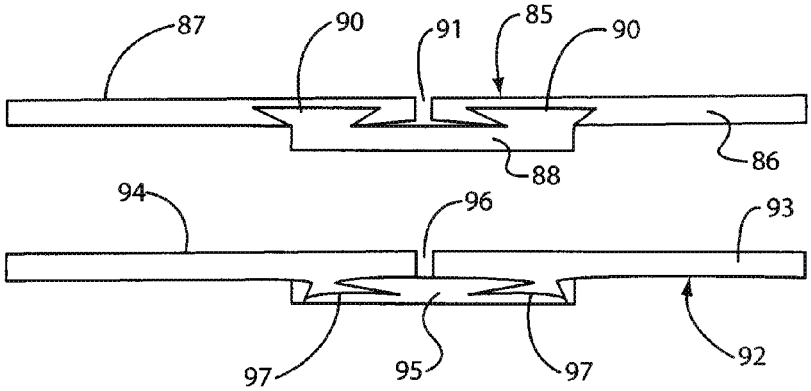
Fig. 14

PRE-ASSEMBLED HIP, RIDGE OR RAKE SHINGLE

CROSS-REFERENCE TO RELATED APPLICATIONS

This is a continuation-in-part of U.S. application Ser. No. 11/689,574, filed Mar. 22, 2007, the complete disclosure of which is herein incorporated by reference.

BACKGROUND OF THE INVENTION

It is known in the shingle art that shingles that are applied to a roof are generally applied in courses, running up the slope of a roof, toward the apex or ridge of the roof.

For example, in applying shingles to different sloped surfaces of a roof, wherein those sloped surfaces meet at an apex, the various courses of shingles on each side of the apex are increasingly disposed up each slope, until the apex or ridge of the roof is reached. At that point, it is desirable to provide a shingle that is a unitary structure that overlies a portion of each sloped surface of the roof, including the apex of the roof.

Sometimes, a piece of shingle is cut to be applied over the shingles on each sloped surface, and over the apex, in an inverted "V" manner. In bending such shingle, generally when it is of the manufactured asphalt shingle type, it is possible that, as the shingle is bent to have an included angle between surfaces thereof, to partially cover each surface of the roof as well as the apex of the roof, cracks can form.

In instances where the shingles are substantially rigid, such as resembling slate, tile, shakes or the like, it is often not practical to bend a shingle to cover the surfaces on each side of the apex of a roof. In some such cases molded plastic ridge cap pieces are applied to cover the gap at the roof edge. In other instances, a row of barrel-like tiles are applied over the apex of a roof. In still other instances, molded bent synthetic slate shingles are pre-shaped to a specific angle, to be applied over the ridge of a roof.

Examples of prior art techniques for covering a hip, ridge or rake portion of a roof exist in U.S. Pat. Nos. 5,295,340, 6,418,692, and 7,178,294.

THE PRESENT INVENTION

The present invention is directed to closing the ridge or hip of a roof that is made up of slates, tiles or shakes without requiring special flashing or a tile arrangement along the top edge of the roof in order to close the roof and prevent water from entering the structure being roofed at the joint between the two slopes of the roof.

SUMMARY OF INVENTION

The present invention provides a hinged, pre-assembled hip, ridge or rake shingle that can be used for synthetic slate, tile, or shake roofing installations, wherein the hinge allows the shingle to accommodate a wide range of intersecting angles on each side of the hip, ridge or rake, at the meeting of a roof joint.

Accordingly, it is an object of this invention to provide a synthetic hip, ridge or rake roofing shingle of the simulated slate, tile or shake types, wherein planar panels of the shingle are connected by a hinge, in which the hinge is relatively flexible relative to the substantially, relatively rigid planar panels, whereby the hinge can conform to a variety of different angles between the substantially rigid planar panels, which angles correspond to different intersecting angles of different adjacent roof surfaces.

It is another object of this invention to accomplish the above object, wherein the hinge is either of the same material, or of a different, softer, more flexible material than the material of construction of the relatively rigid planar panels of the shingle.

It is another object of this invention to accomplish the above objects, wherein the hinge of the shingle includes a reinforcement.

Other objects of the invention include accomplishing the above objects, wherein the hinge is a separate member that is either laminated to the relatively rigid panels, heat sealed thereto by welding techniques such as ultrasonic or vibratory welding, adhesively connected thereto, or mechanically fastened or mechanically interlocked thereto.

It is a further object of this invention to accomplish the above objects, wherein the relatively rigid panels are connected together by a layer of release tape across the hinge-like portion, to facilitate stacking of the shingles in substantially flattened condition, or to facilitate the openability of the hinge to accommodate various potential angles between the panels in the installed condition of shingles on a roof.

BRIEF DESCRIPTION OF THE DRAWING FIGURES

FIG. 4 is a top perspective view of another alternative embodiment of the shingle of this invention.

FIG. 5 is an end view of the shingle of the embodiment of FIG. 4 in accordance with this invention.

FIG. 6 is an end view of another alternative embodiment of the shingle of this invention.

FIG. 7 is a fragmentary transverse sectional view, taken through another alternative embodiment of the shingle, wherein the shingle of FIG. 7 embodies substantially rigid planar panels each of core and capstock material, connected together by a hinge of material having a fabric-like reinforcement embedded therein.

FIG. 8 is an end view of another alternative embodiment of the shingle of this invention.

FIGS. 9-20 are end views of other alternative embodiments of the shingle of this invention.

Figure 24:
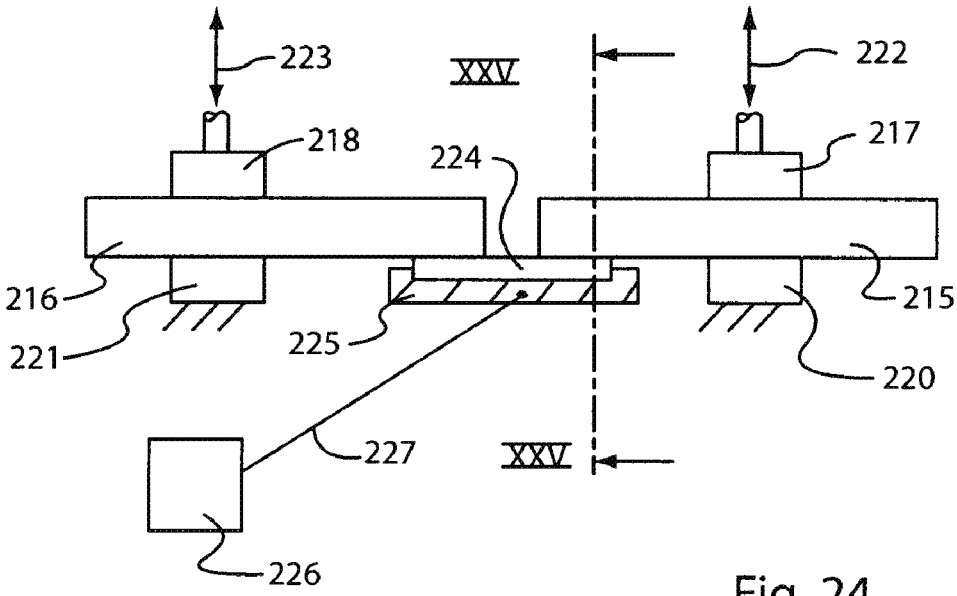

FIG. 24 is a schematic illustration of a pair of relatively rigid synthetic thermoplastic polymeric shingle panels held in stationary jigs while a relatively flexible synthetic thermoplastic polymeric hinge, carried in a movable fixture, is vibrated back and forth by a vibratory technique, either mechanically operated or operated by ultrasonic means, to create sufficient frictional heat between the mating surfaces of the panels and hinge to melt at least some of their adjacent surface portions, after which the vibration is discontinued and the panels and hinge are held together until the melt solidifies and the panels and hinge become fused together as a unitary structure.

Figure 25:
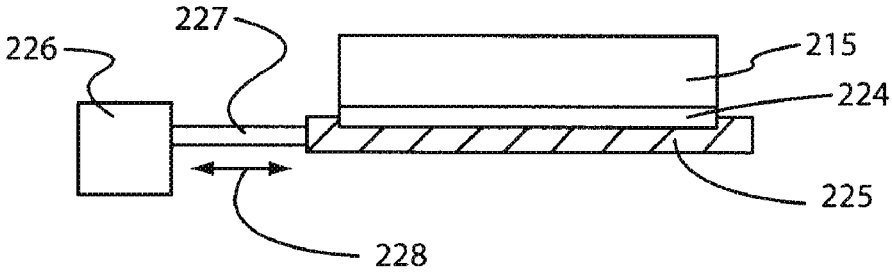

FIG. 25 is a sectional view taken through the illustration of FIG. 24, generally along the line XXV-XXV of FIG. 24, and wherein the lateral back-and-forth vibratory motion is schematically illustrated, for creating the friction between the hinge and each of the panels.

DETAILED DESCRIPTIONS OF THE PREFERRED EMBODIMENTS

Figure 1:
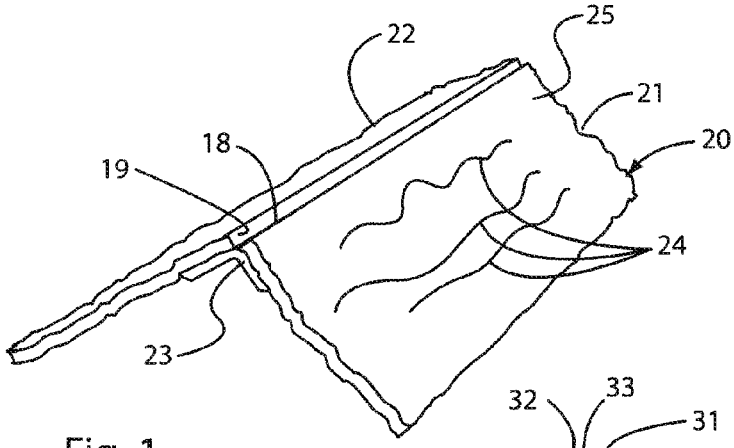
FIG. 1 is a top perspective view of a shingle in accordance with this invention.
Figure 2:
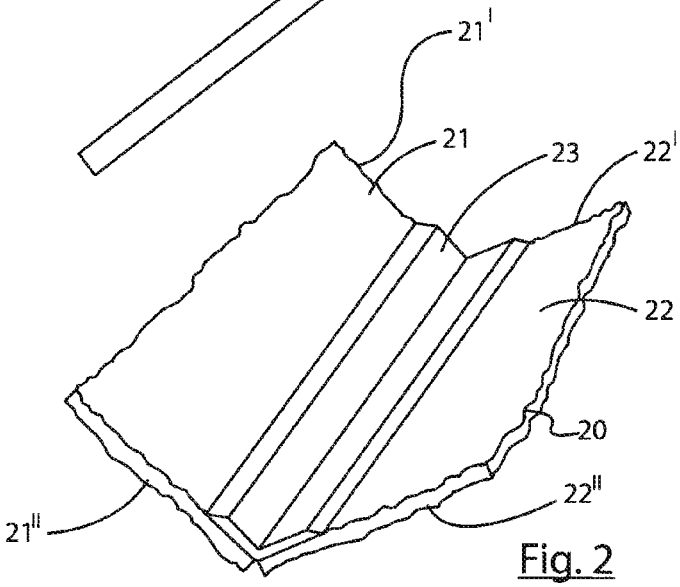
FIG. 2 is a bottom perspective view of the shingle of FIG. 1 in accordance with this invention.

Referring now to the drawings in detail, reference is first made to FIG. 1, wherein a shingle 20 in accordance with this invention is illustrated as having a pair of substantially rigid planar panels 21 and 22 having opposite ends 21', 21", 22', 22" as shown in FIGS. 1 and 2, and which are connected together by a hinge 23 that is softer, relatively more flexible than the substantially ridge-like planar panels, to facilitate bending to different angles as may be required with the hinge being co-extensive between said opposite ends 21', 21", 22', 22" of said rigid planar panels 21 and 22 as is shown in FIG. 2. The relatively flexible hinge 23 in the embodiment of FIG. 1 is of a separate structure, or different material than panels 21 and 22 and can be rubber-like or elastomeric.

A plurality of relief zones or areas 24 are provided on the upper exterior surface 25 of the shingle 20, simulating natural slate, tile, or shake, such as cedar shake, shingles or the like, with the aesthetic presentation of the relief areas 24 being selected as may be desired.

Each of the substantially rigid panels 21, 22, may, if desired, be constructed of a single material, or, alternatively, they may be constructed of a core material having exterior surfaces that would be weather-exposed in the installed condition on a roof, being a capstock material coating thereon (not shown).

In FIGS. 1 and 2 it will be seen that the synthetic shingle panels 20 and 21 may have different configurational aspects, such as different shapes, edge configurations, sizes, thicknesses, textures, or even be of different colors or shades, or combinations thereof, to yield a hip, ridge or rake shingle that has enhanced natural-looking features, for example, as though the different panels were cut from different slates, shakes, tiles or the like.

Figure 3:
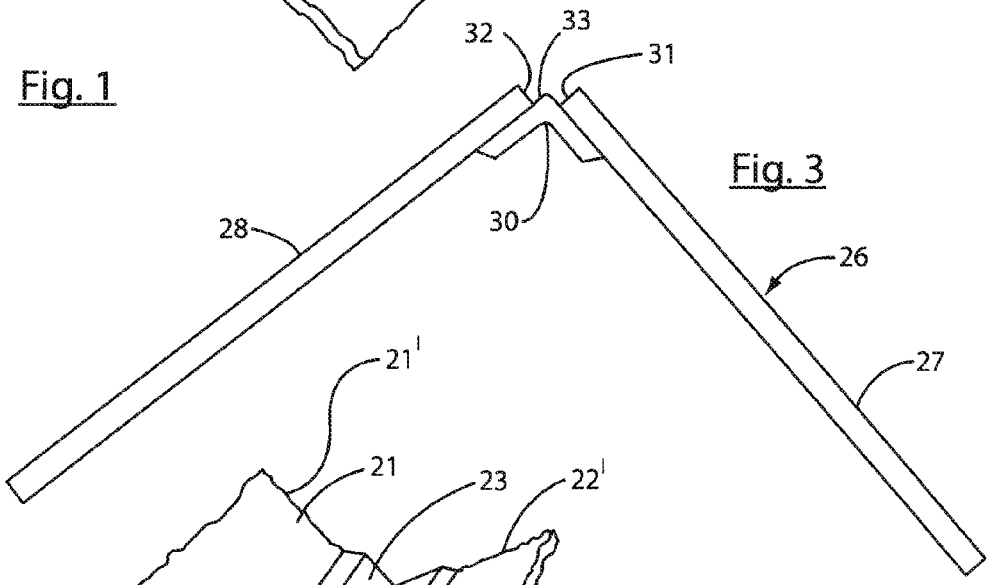
FIG. 3 is an end view of a slightly modified form of the shingle of FIG. 1 of this invention.

With reference to FIG. 3, an alternative shingle 26 is provided, comprised of panels 27 and 28 that are substantially rigid, connected by a substantially flexible hinge 30, as shown, wherein, upper edges 31 and 32 do not extend completely to the apex 33 of the hinge 30 shown in FIG. 3, unlike the shingle 20 of FIG. 1, in which the edges 18 and 19 meet as shown in FIG. 1.

Otherwise, the shingle of FIG. 3 is similarly constructed to the construction of the shingle 20 of FIG. 1.

With reference to FIG. 4, a shingle 35 is shown, having substantially rigid panels 36, 37 connected by a hinge 38. The shingle of FIG. 4 is constructed to be similar to the shingle of FIG. 1, likewise having relief areas 40 thereon as may be desired, except that the upper end 41 of the substantially rigid panel 36, overlies the upper end 42 of the substantially rigid panel 37, as shown in FIG. 4.

FIG. 5 provides an end view of the shingle illustrated in FIG. 4.

FIG. 6 illustrates a shingle similar to that of FIG. 5, identified generally by the numeral 44, but wherein the upper edge 45 of the substantially rigid panel 46 is covered by the upper end 47 of the substantially rigid panel 48, in a manner opposite to the arrangement of FIG. 5, with a substantially flexible hinge 50 connecting the same.

In the embodiments illustrated in FIGS. 5 and 6, there are shown in phantom, optional respective projections 39 and 49, respectively, of rigid panels, extending respective amounts "A" and "B", for aesthetic purposes, simulating additional height or thickness at the bend of the hip/ridge/rake shingles 35, 44, respectively, when installed, as possible other features for those shingles 35 and 44. In FIGS. 5 and 6, it will be seen that the welded connection of the hinge 38 to the panel 37 is adjacent the edge or end 42 of the panel 37, whereas the hinge 38 is connected to the panel 36 at a location on the panel 36 that is inboard of the upper end or edge 41 of the panel 36 an amount that is greater than the weld location of the hinge 38 on panel 37. In FIG. 6, the opposite can be readily seen with respect to the hinge 50 and panels 46 and 48.

In all of the embodiments illustrated in FIGS. 1-6, it will be seen that the hinges 23, 30, 38 and 50 are of a separate material than the material of construction of the substantially rigid panels, and is more readily foldable, or rubber-like, and can be adhered to the substantially rigid panels by any of a variety of techniques, such as being laminated thereto, being heat sealed thereto, being adhesively secured thereto, or mechanically fastened thereto in some manner as will be described in examples later to be discussed herein.

With reference now to FIG. 7, a hip ridge or rake shingle 51 is shown, in section, in which each of the substantial rigid panels 52, 53 is comprised of a core material 54 having its weather-exposed portions in the installed condition, covered by a capstock material 55, as shown. A separate material is used to provide the substantially flexible hinge 56. The hinge 56 is secured to each of the substantially rigid panels 52 by any of the techniques described above. However, in the embodiment of FIG. 7, the hinge 56 is provided with a reinforcement member 57 that can be a woven scrim, or woven fabric, for example. The reinforcement could also be a non-woven scrim or fabric, or even a film, any of which reinforcements can be embedded into the hinge 56, such as during a molding operation or the like, or could be adhered to either an upper or lower surface of the hinge 56 (not shown).

With reference to FIG. 8, another hip, ridge or rake shingle 60 is illustrated, comprising substantially rigid panels 61 and 62, connected by a relatively flexible hinge 63, also comprising a different element than either of panels 61, 62, preferably constructed of a different, softer material than the material of construction of either of the substantially rigid panels 61, 62.

In FIG. 9, yet another alternative embodiment is illustrated, wherein the substantially rigid panels 65, 66 of the hip, ridge or rake shingle 67 are connected by a hinge 68 that is constructed of the same material of construction as are the substantially rigid panels 65, 66, but in order to be flexible, the hinge 68 may be thinner, or may be scored (not shown), or otherwise mechanically altered to bend more easily and be more flexible for serving the function of a hinge.

With reference to FIG. 10 it will be seen that a hip, ridge or rake shingle member 70 is shown, which can be of a single material of construction, having substantially rigid panels 71 and 72, connected by a thinner hinge 73, which enables the shingle 70 to be molded of a unitary material, or of a core material having a capstock material thereon (not shown). In the embodiment of FIG. 10, a sheet of release tape 74 is shown connecting the relatively rigid panels 71 and 72, across the hinge 73, to keep the shingle 70 generally flat, for purposes of stacking a plurality of shingles in a container, one atop the other, for example. The release tape 74 may be removed for purposes of bending the shingle 70 to have different angular accommodations depending upon the slopes of different surfaces of a roof to which is applied, or the tape 74 could simply be released from one side, to be free of one of the panels 71 or 72, for purposes of installation of the shingle 70 on a roof.

The shingle 79 of FIG. 11 illustrates another alternative embodiment, in which the hinge 77 is unitary with the substantially rigid panels 75 and 76, and in the flattened condition shown has a space 78 between the substantially rigid panels, so that in the configuration shown in FIG. 11, the shingle 79 may also be readily stacked.

In FIG. 12, there is illustrated a shingle 80, somewhat similar to the shingle 79 of FIG. 11, but wherein the substantially rigid panels 81 and 82 are connected by a differently configured hinge 83 than that 77 for the shingle 79 of FIG. 11, but wherein the substantially rigid panels likewise have a space 84 therebetween, in the flattened condition shown for the shingle 80, also for stacking purposes, but wherein the hinge is substantially wider than that shown in FIG. 11.

With reference, for example, to FIGS. 9, 11, and 12, it will be seen that those shingles 67, 79 and 80, respectively are adapted to being molded, such that their substantially rigid panels as well as their hinge, can be molded together as a unit. However, in order to allow separation of the substantially rigid panels of each shingle in the vicinity of the hinges, there can be provided strips of release tape T1, T2 and T3, respectively, to keep the substantially rigid panels and their connecting hinges from becoming adhered together, to allow the ready bending of the integrally molded shingles 69, 79, 80, respectively, to be bent from their originally flattened conditions, such that their opposing substantially rigid panels can be bent to have an angular relationship to each other, somewhat like the bent shingles of FIGS. 1 through 7.

Figure 20:
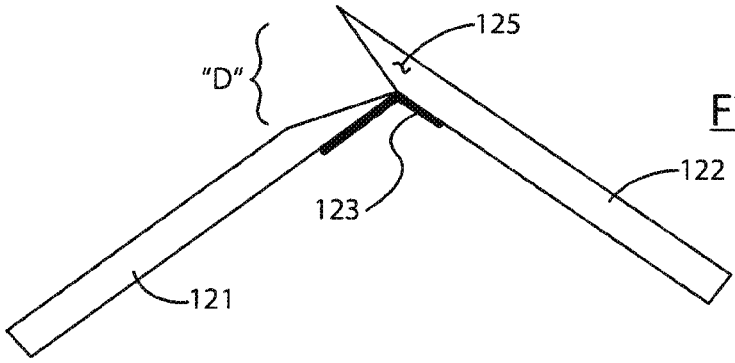

With reference to FIGS. 12A and 12B, it will be seen that the space 84 illustrated in FIG. 12 could be located either leftward of center, as shown in FIG. 12A, and which is indicated as 84', or rightward of center as shown in FIG. 12B, and which is indicated as 84", such that when the shingle of either of FIG. 12A or 12B is bent along the hinge 83 thereof, a projected height for aesthetic purposes can be provided for either of the substantially rigid panels 81 or 82, somewhat similar to the extensions of FIGS. 5, 6 and 20 herein.

With reference to FIG. 13, a hip, ridge or rake shingle 85 is illustrated, in which the substantially rigid panels 86 and 87 are connected by substantially flexible hinge 88, which has a dovetail type mechanical interlock 90 connecting the hinge 88 to the substantially rigid panels 86 and 87, across the space zone 91, as shown, and wherein the substantially flexible hinge 88 is comprised of a different material element than either of the substantially rigid panels 86 and 87.

In FIG. 14, a hip ridge or rake shingle 92 is illustrated, comprised of substantially rigid panels 93 and 94, connected together by substantially flexible hinge 95, across the space 96 between the substantially rigid panels, and wherein a different dovetail type connection that forms a mechanical interlock 97, is shown, relative to that illustrated in FIG. 13. The hinge 95, like that 88 of FIG. 13, is shown being comprised of a different material element, selected to be sufficiently flexible to act in the manner of a hinge when the substantially rigid panels 93 and 94 are folded to have an included angle therebetween to accommodate a hip, ridge or rake of a roof of any desired slopes between surfaces thereof.

The embodiments of FIGS. 13 and 14, like those of FIGS. 10-12, illustrate the manner in which the shingles may be stored and shipped in relatively flattened form, to be folded to the desired angles when applied to roofs.

Figure 15:
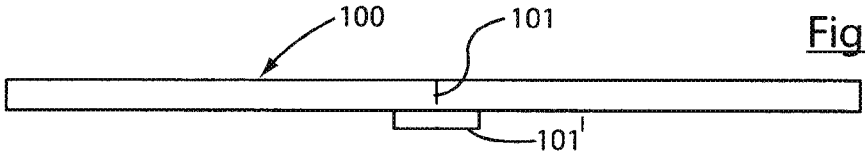
Figure 16:
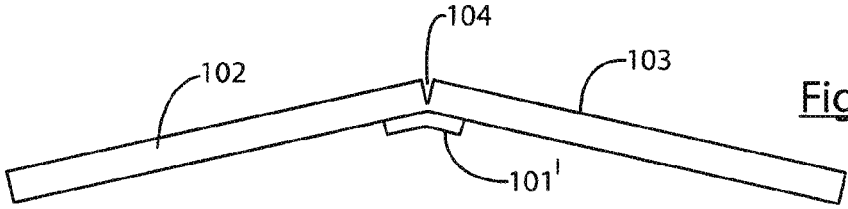

With reference now to FIG. 15, a shingle 100 is shown, which is molded into the flat form illustrated in FIG. 15, and simultaneously therewith or thereafter a cut 101 can be made after the shingle or tile is molded, which cut 101 will facilitate the bending of the shingle thereafter as shown in FIG. 16 to have two substantially rigid panels 102 and 103 foldable as shown, along a fold line 104, such that the shingle or tile can thus conform to the shape of the ridge of a roof, or to other angularly related surfaces of a roof.

Figure 17:
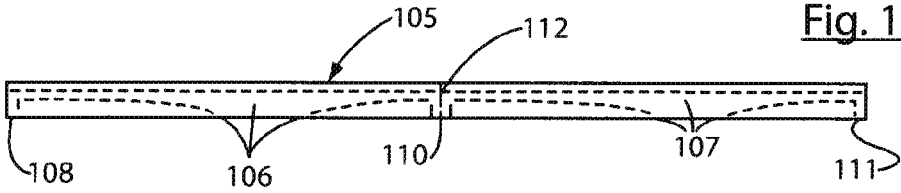
Figure 18:
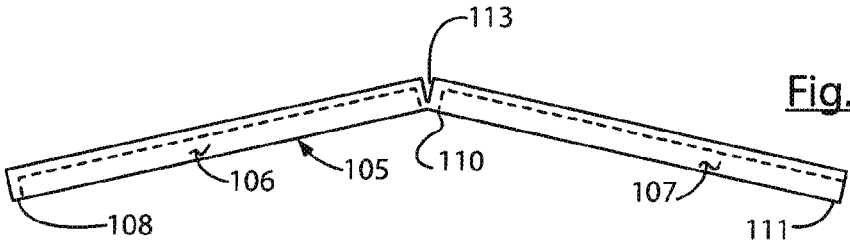

With reference to FIG. 17, a shingle 105 is shown, similar to that 100 of FIG. 15, and which is hollowed-out at 106 and 107, to reduce weight and to reduce the amount of material required, but wherein ribs 108, 110 and 111 facilitate the support of the shingle or tile on the roof, when installed. Like the illustration of FIG. 16, the shingle 105 can have a cut 112 applied with the making of the shingle, or thereafter, to yield a fold line 113 as shown in FIG. 18. Alternatively, the cut lines 101 and 112 of FIGS. 15 and 17, respectively, could be score lines, if desired, which could become open cut lines as the shingles 100, 105, respectively are bent from their flattened positions illustrated in FIGS. 15 and 17, respectively, to their bent positions illustrated in FIGS. 16 and 18, respectively.

Figure 19:
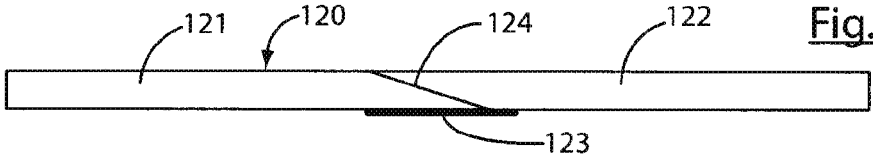

With reference to FIG. 19, another shingle or tile 120 is illustrated in flattened form, as comprising two parts 121 and 122, connected by a laminated or otherwise foldable member 123, with the two components 121 and 122 having a separation or cut line 124 therein, with the cut line 124 being of the beveled type shown, and with the laminate or other layer 123 providing a hinge-like effect, such that, when the shingle is bent from its position illustrated in FIG. 19 to the position illustrated in FIG. 20, the upwardly extending portion 125 of component 122 projects upwardly an amount "D", yielding a projected height "D" for aesthetic purposes, simulating additional height or thickness at the bend of the hip/ridge/rake shingle when installed, but with the shingle or tile also having the ability to lay flat as shown in FIG. 19, for packaging purposes, shipment, or the like.

Figure 21:
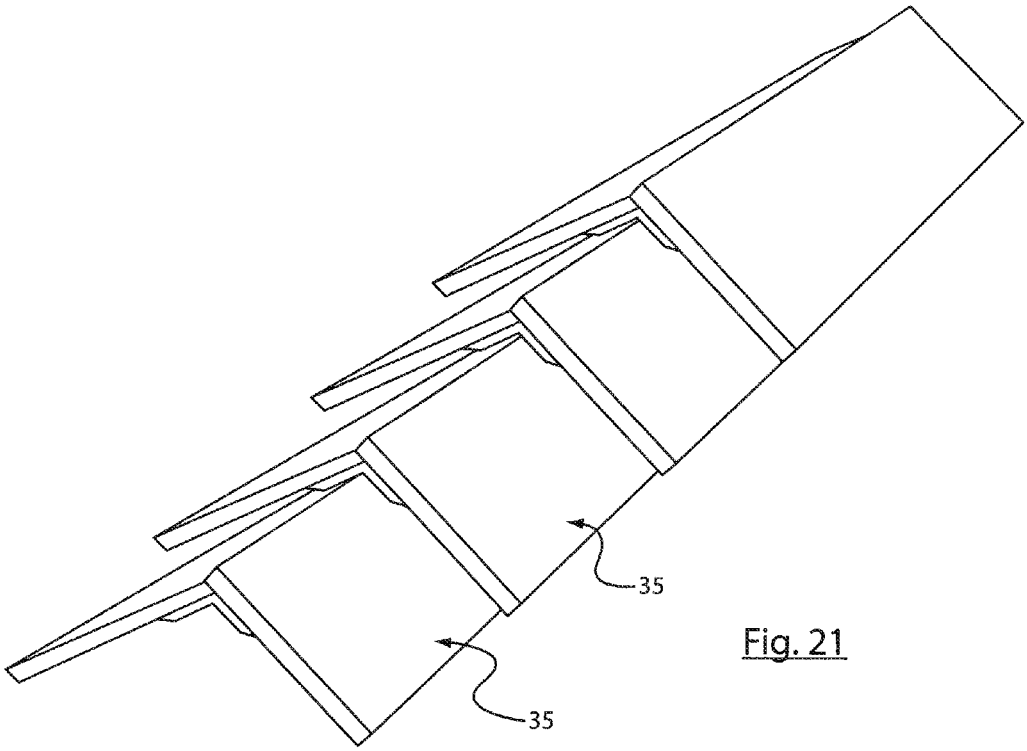
FIG. 21 is a top perspective view of an array of shingles in accordance with this invention, laid up, with lower portions of each successive shingle covering upper portions of a next-subjacent shingle, as they would be laid up along a ridge or apex of a roof.

With reference to FIG. 21, it will be seen that a plurality of shingles such as those 35 of FIG. 4 are applied in a course, at the apex of a roof, be it a hip roof (generally having four sloped surfaces), or along a ridge of two opposing sloped surfaces or the like, wherein the upper end of an underlying shingle is partially covered by the lower end or the next-overlying shingle, as shown.

Figure 22:
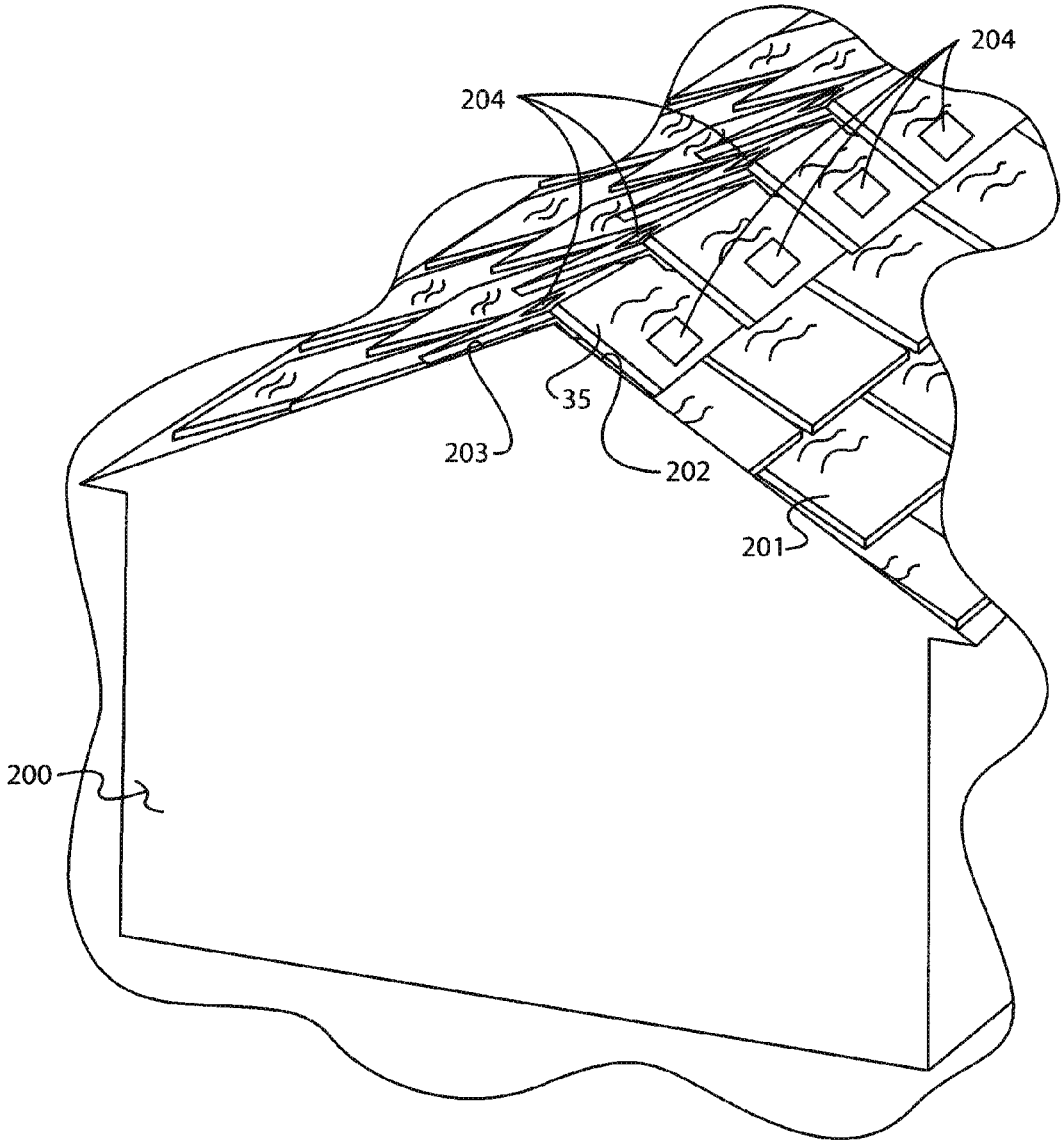
FIG. 22 is a fragmentary illustration of a building having shingles applied to different surfaces thereof, which surfaces meet at a ridge, and wherein shingles of this invention similar to those of FIGS. 4 and 5, are applied to the ridge of the roof as shown in FIG. 21.

With reference to FIG. 22, it will be seen that a building 200 is shown, having a plurality of shingles 201 applied thereto, along two sloped surfaces 202 and 203, and wherein the ridge of those sloped surfaces 202 and 203, has a plurality of shingles 35 of the type illustrated in FIG. 21 applied thereto, in a course, along a ridge. Optionally, photovoltaic elements 204 may be employed on the shingle panels.

Figure 23:
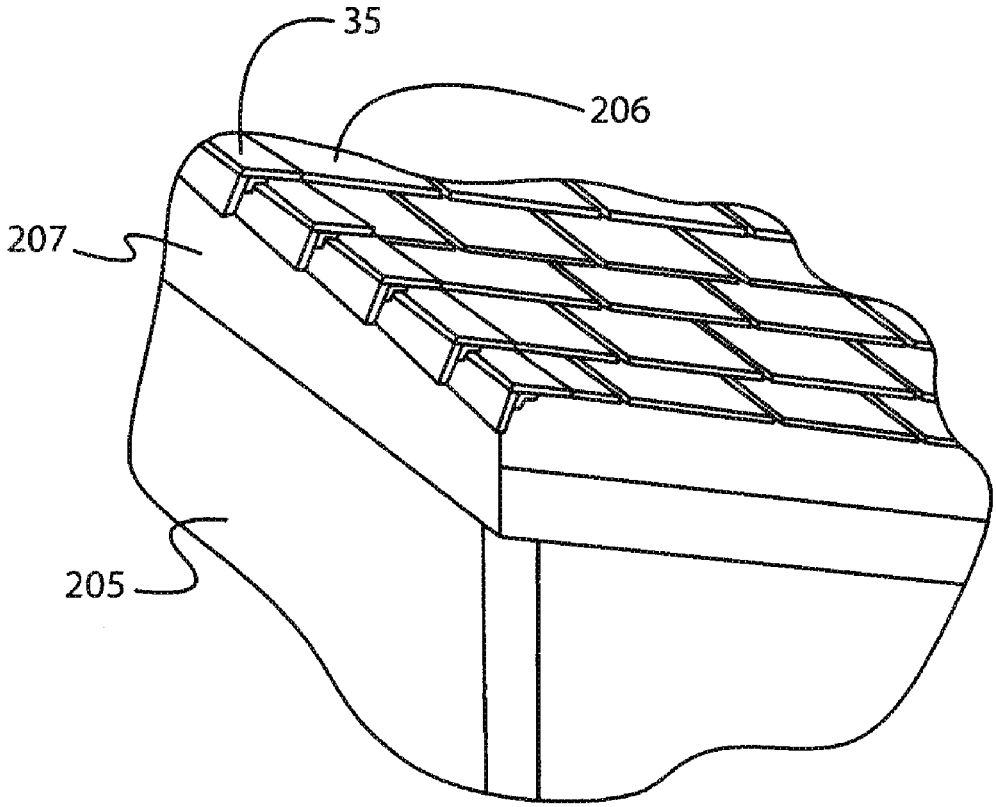
FIG. 23 is a fragmentary illustration of a building structure, wherein shingles in accordance with this invention are applied as rake shingles.

FIG. 23 illustrates the manner in which shingles of the type of this invention are applied to a building 205, in the manner of rake shingles, with one relatively rigid panel of each shingle overlying a sloped surface of a roof having roofing shingles applied thereto, as shown at 206, and with the other panel of the rake shingles applied partially covering a generally vertical surface 207 thereof.

With reference now to FIGS. 24 and 25, it will be seen that the panels 215 and 216, that are of synthetic thermoplastic polymeric material, are each held fixed in respective upper jigs 217, 218 and lower jigs 220, 221. The jigs 220 and 221 may for example be fixed against motion, and the upper jigs 217, 218 may be movable upwardly and downwardly in the direction of the arrows 222, 223, such that when the jigs 217, 218 are moved downwardly, they can clamp the panels 215, 216 against jigs 220, 221, respectively. Another synthetic thermoplastic polymeric material that is to comprise the hinge 224 is held in a fixture 225, that suitably grips the same, and a vibrator means 226 is connected to the fixture 225 by a suitable connecting element 227, that moves the fixture 225 and the hinge-forming member 224 laterally, or backwards and forwards, which, in the illustration of FIG. 24 would be into and out of the plane of the paper, or in the sectional illustration of FIG. 25, leftward and rightward in the direction of the arrow 228. Such vibratory motion can be either mechanically operated or ultrasonically operated, but, in any event, will create sufficient frictional engagement between the hinge-forming member 224 and each of the panels 215, 216, that the friction will create enough heat to melt some of the thermoplastic material of the panels 215, 216 and hinge-forming member 224, where they are in engagement with each other, and that, once the vibratory motion is discontinued, and the panels 215, 216 and hinge-forming member 224 remain held together for a predetermined hold time the engaging surfaces of the panels 215 and 216 and the engaging surface of hinge 224 will become fastened together as a unitary structure that is a hip, ridge or rake shingle.

In producing the vibration that creates sufficient friction to melt the thermoplastic material for attaching the hinge to the panels by ultrasonic means, the high-frequency vibrations may be above 20,000 cycles per second. Alternatively, vibrating motion in the range of several hundred cycles per second under load may be employed due to mechanical vibration. Electric or magnetic energy is generally transferred into mechanical energy, as described above with respect to the illustrations of FIGS. 24 and 25, which, in turn, produces the friction that raises the temperature of the components being frictionally engaged with each other an amount sufficient to melt the thermoplastic material.

The individual panels can be formed by known processes, such as compression molding, injection molding, blow molding, or extrusion followed by compression molding. Additionally, other means of construction known in the art can be used to produce the shingles in accordance with this invention. It will thus be seen that the shingles in accordance with this invention can be pre-assembled as hip, ridge and rake shingles. It will also be seen that the shingles can be produced by having a separate hinge connecting separate substantially rigid panels. Alternatively, a profile extrusion can be used, such as is shown in FIGS. 9-12, whereby the shingle panels are extruded from a die and the die includes a feature that becomes the hinge in a finished shingle when cut to shape. The profile extrusion can be an open flat overall shape, a folded overall shape, or a desired shape in between a folded shape (such as shown in FIGS. 8 and 9) and flat overall shapes (such as shown in FIGS. 10-15, 17 and 19). Also, the hinge can be produced by co-extrusion to produce a hinge with different physical or mechanical properties from the main portions or substantially rigid panels. Alternatively, the hinge can be produced separately and assembled with the rigid panels to yield the shingle of the invention. The hinge or connection can be comprised of any of a laminated connection, a heat sealed connection, an adhesive connection, a mechanical fastener connection, a co-extruded connection, and a molded connection. The substantially rigid panels can be made of a synthetic polymer that can be a thermoplastic material and may be comprised, in whole or in part of a polyethylene material, a polypropylene material, a polymethylpentene material, a polybutene material, a polyacrylate material, a polyvinylchloride material, a fiber cement material (i.e. a cement-like material having fibers therein), or blends of various synthetic polymers, all as may be desired.

The panels of thermoplastic polymeric construction, with the hinges of thermoplastic polymeric construction as are shown, for example, in FIGS. 1-6, 8, 13 and 14 and the shingles with their reinforcements of FIGS. 15 and 16, as well as the array of shingles illustrated in FIG. 21 all comprise shingle panels made of synthetic thermoplastic polymeric materials, as well as do the hinges and reinforcement members such as those 101' of FIGS. 15 and 16.

Both ultrasonic vibration welding and mechanical vibration welding are techniques that are used to adhere the hinge and/or a reinforcement member to the shingle panels, in that these techniques provide energy to the portions of the parts that are to be joined together, where the energy in converted to heat through friction that melts the thermoplastic polymeric material of the panels and the hinge or reinforcement member. This welding is part of a preferred cycle time that includes mounting of the panels and hinge in appropriate jigs and fixtures, performing the welding operation, cooling or solidifying the weld and removing the shingle from the jigs or fixtures and is of a duration of less than about 30 seconds, and even more preferably of less than about 20 seconds. Thereafter, the hold time, which is the time during the welding step that the hinge and/or reinforcement member is held pressed against the shingle panels, followed by cooling of the melted thermoplastic resulting from the welding step is preferably less than about 10 seconds, and more preferably less than about 5 seconds, after which hold time the hinge and/or reinforcement member is in heat-sealed connection to the panels. Whether the welding step is ultrasonic vibration welding or mechanical vibration welding, it is preferred that the hinge and/or reinforcement member is welded simultaneously to both of the shingle panels, although, if desired, such may occur sequentially, first to one of the panels, and thereafter to another of the panels. It is preferred that the vibration welding be linear vibration welding, providing a linear back-and-forth vibratory movement between the components that are being welded together, while applying a force or pressure to the components that are being welded together but alternatively, orbital vibration may be employed. During the welding, some of the thermoplastic material of the components that are being welded together melts, and the components are then held together during the hold time, while the melt solidifies, such that the components that are being welded together become as one; a unitary hip, ridge or rake shingle.

Also, in accordance with this invention, at least one of the shingle panels may include a photovoltaic element. Preferably, the photovoltaic element would face in the direction in which the roof receives the greatest amount of sun, for providing energy to the photovoltaic element. In some cases, photovoltaic elements may appear on both panels of a hip, ridge or rake shingle, but wherein one of the panels may have a greater active photovoltaic area than the other panel. In some cases, it may be desirable that only one of the two panels of a hip, ridge or rake shingle may have an active photovoltaic area, for example, for purposes of cost savings, in not providing photovoltaic areas on a panel that is not going to receive substantial amounts of sun. Also, in accordance with this invention, it will be understood that an array of shingles laid up on a roof, most particularly, hip, ridge or rake shingles laid up on a roof, as is illustrated in FIG. 22 may employ photovoltaic elements on one or both sides of the shingle, either separately from the field shingles, or in addition to the field shingles and/or, wherein different amounts of photovoltaic areas of the panels may be employed.

Examples of vibration welding techniques and/or ultrasound welding techniques applicable to the present invention are set forth in U.S. Pat. Nos. 3,224,915; 3,419,447; 3,733,238; 3,998,377; 4,618,516; 5,401,342; 6,260,315; 6,797,089; U.S. 2007/0272723 and U.S. 2007/0051451, the complete disclosures of which are herein incorporated by reference.

It will be apparent from the forgoing that various modifications can be made in the shingle of this invention, the details of construction, the formulations thereof, or the like, as well as in the use of the shingles, all within the spirit and scope of the invention as set forth in the appended claims.

What is claimed is:

1. A method of making a synthetic hip, ridge or rake roofing shingle of any of the simulated slate, tile or shake types, comprising the steps of:

(a) providing a first synthetic shingle panel comprising a thermoplastic polymeric material;

(b) providing a second synthetic shingle panel comprising a thermoplastic polymeric material;

(c) providing a hinge of thermoplastic polymeric material, having first and second portions;

(d) welding a first portion of the thermoplastic hinge to an adjacent portion of the first synthetic hinge panel;

(e) welding a second portion of the thermoplastic hinge to an adjacent portion of the second synthetic shingle panel; and (f) whereby the thermoplastic hinge links the two synthetic shingle panels together in a hinged relationship, as a unitary hip, ridge or rake shingle.

2. The method of claim 1, wherein the welding steps are selected from the group of welding techniques of (a) ultrasonic welding; and (b) vibration welding.

3. The method of claim 2, wherein the welding steps are vibration welding of the lateral vibration welding type.

4. The method of claim 2, wherein the welding steps have a cycle time of less than about 30 seconds.

5. The method of claim 2, wherein the welding steps have a cycle time of less than about 20 seconds.

6. The method of claim 2, wherein the welding steps have a hold time of less than about 10 seconds.

7. The method of claim 2, wherein the welding steps have a hold time of less than about 5 seconds.

8. The method of claim 1, wherein the welding steps of clauses (d) and (e) of claim 1 are accomplished simultaneously.

9. The method of claim 1, including the step of welding the hinge to the first shingle panel adjacent an edge of the first shingle panel, and welding the hinge to the second shingle panel at a location on the second shingle panel that is inboard of the edge of the second shingle panel an amount greater than the location of welding of the hinge to the first shingle panel is from the edge of the first shingle panel.

10. The method of claim 1, wherein the steps of welding the thermoplastic hinge to the shingle panels includes providing a reinforcement welded to each of the shingle panels.

* * * * *